US007054460B2

(12) United States Patent
Rombach et al.

(10) Patent No.: US 7,054,460 B2
(45) Date of Patent: May 30, 2006

(54) MICROMACHINED MAGNETICALLY BALANCED MEMBRANE ACTUATOR

(75) Inventors: Pirmin Rombach, Kgs. Lyngby (DK); Jörg Rehder, Copenhagen (DK)

(73) Assignee: SonionMEMS A/S, Kongnes Lyngby (DK)

( * ) Notice: Subject to any disclaimer, the term of this patent is extended or adjusted under 35 U.S.C. 154(b) by 91 days.

(21) Appl. No.: 09/964,897

(22) Filed: Sep. 28, 2001

(65) Prior Publication Data

US 2002/0064292 A1 May 30, 2002

Related U.S. Application Data

(60) Provisional application No. 60/236,333, filed on Sep. 29, 2000.

(51) Int. Cl.
*H04R 25/00* (2006.01)

(52) U.S. Cl. ..... 381/421; 381/414; 381/417; 381/420

(58) Field of Classification Search ..... 381/396, 381/398–402, 406–408, 411–412, 414, 417–418, 381/420–422, 152, 171, 173, 182, 191, 431, 381/409, 410, 413, 419
See application file for complete search history.

(56) References Cited

U.S. PATENT DOCUMENTS 4,000,381 A * 12/1976 Plice et al. ..... 381/412
4,015,227 A 3/1977 Riko et al.
5,299,176 A 3/1994 Tibbetts
5,432,758 A 7/1995 Sone
5,809,157 A * 9/1998 Grumazescu ..... 381/412
5,960,093 A 9/1999 Miller
5,960,096 A 9/1999 Imahori et al.

FOREIGN PATENT DOCUMENTS

EP 0 548 580 A1 6/1993
EP 0 851 710 A1 7/1998

OTHER PUBLICATIONS

"Magnetic Flux Generator for Balanced Membrane Loudspeaker". Jörg Rehder, et al., Denmark, 5 pgs.
"Balanced Membrane Micromachined Loudspeaker for Hearing Instrument Application", Jörg Rehder, et al., Denmark, 4 pgs.
"Balanced Membrane Micromachined Loudspeaker for Hearing Instrument Application", Jörg Rehder, et al, Institute of Physics Publishing, Journal of Micromechanics and Microengineering, Jan. 5, 2001, pp. 334–338.
JP 9331596 A (Abstract).
JP 7015797 A (Abstract).

* cited by examiner

*Primary Examiner*—Suhan Ni
(74) *Attorney, Agent, or Firm*—Harness, Dickey & Pierce, PLC

(57) ABSTRACT

The present invention relates to an miniature actuator especially suitable for hearing aid applications. The actuator according to the present invention operates according to the change in reluctance principle. In particular, the actuator according to the present invention operates in a balanced configuration comprising two planar coils, two magnets, a membrane and a spacer chip providing the necessary back chamber volume.

21 Claims, 5 Drawing Sheets

2a

2b

3a

3b

MICROMACHINED MAGNETICALLY BALANCED MEMBRANE ACTUATOR

This nonprovisional application claims priority under 35 U.S.C. §119(e) on U.S. Provisional Application No. 60/236,333 filed on Sep. 29, 2000, which is herein incorporated by reference.

FIELD OF THE INVENTION

The present invention relates to an actuator for hearing instruments operating according to the change in reluctance principle. In particular, the actuator according to the present invention operates in a balanced configuration comprising two planar coils, two magnets, a membrane and a spacer chip providing the necessary back chamber volume.

BACKGROUND OF THE INVENTION

Today, hearing instruments have dimensions which allow them to fit into the ear canal of a human being nearly invisible to the environment. Therefore, the dimensions of the components making up a hearing instrument have to decrease. This implies an enormous increase of the requirements of the traditional technology used during the last years. The fabrication is labour intensive, and thus very cost intensive. Furthermore, the traditional loudspeaker is shock sensitive and vibrations at higher sound levels may easily cause the well-known feedback problem of hearing instruments.

Micro-system technology (MST) provides an opportunity of batch processing which leads to low cost and good reproducibility. Full integration of electronic circuitry on the same substrate is possible and the advanced structuring technologies provide the opportunity of well-defined devices with at least a decade of better tolerances compared to traditional precision engineering. The number of publications on realised loudspeakers using MST is small and none of these loudspeakers fulfils the requirements for an application in a hearing instrument.

The loudspeaker system of a hearing instrument consists mainly of two volumes, the ear canal and the loudspeaker itself. The dimension of the ear canal and the loudspeaker is small compared to the wavelength in the considered frequency range, hence the acoustic pressure due to the sound pressure in the ear canal is approximated as quasi static. Thus, the loudspeaker is comparable to a pump. Many publications are available on this type of micro-system actuator, but issues like low supply voltages and low power consumption have not been addressed.

In order to produce a sound pressure of 106 dB SPL, the volume, V, of the ear canal (2 $cm^3$) has to be changed by $\Delta V=0.0806\ mm^3$, which corresponds to an effective pressure of about 4 Pa and a peak value of 5.6 Pa.

U.S. Pat. No. 5,960,093 discloses a miniature actuator suitable for operating as a loudspeaker in a hearing instrument. The actuator disclosed in U.S. Pat. No. 5,960,093 comprises a membrane, an armature, a cylindrical coil, permanent magnets and a drive pin in order for the armature to drive the membrane. The membrane is a stiff plate fixed on one side allowing only rotational movements. The membrane is connected to the armature by the drive pin opposite the fixed side. The armature itself is part of two parallel magnetic circuits and conducts the magnetic flux resulting from the driving voltage applied to a coil in the circuit.

A disadvantage of the actuator disclosed in U.S. Pat. No. 5,960,093 is the strong vibration resulting from the unbalanced position of the force acting point on one side of the membrane. This requires also larger deflection of the armature in order to reach the same change in volume as a membrane deflected in a position closer to the pivot leading to a lower efficiency.

It is another disadvantage of the actuator disclosed in U.S. Pat. No. 5,690,093 that the drive pin connecting the membrane and the actuator induces additional mechanical resonances to the system thereby influencing the overall performance of the actuator.

It is an object of the present invention to provide an actuator optimised for operating in environments typical for those of a hearing instrument e.g. low voltage supply and low power consumption.

It is a further object of the present invention to provide a miniature actuator having physical dimensions which allows it to fit into a hearing instrument.

It is a still further object of the present invention to provide a miniature actuator operating according to the change in reluctance principle whereby the active part of the actuator also forms a part of a magnetic path of the actuator.

SUMMARY OF THE INVENTION

The above-mentioned objects and other objects are complied with by providing, in a first aspect, a miniature actuator comprising a first flux generator for generating a controllable first magnetic flux, a second flux generator for generating a controllable second magnetic flux, a movable diaphragm, and means for generating a permanent magnetic flux, wherein the movable diaphragm is positioned between the first and second flux generator, and wherein the movable diaphragm forms a part of a magnetic flux path of the actuator and thereby being movable in response to the generated first and second magnetic fluxes.

The first and second flux generators may in principle be any kind of generators capable of generating a controllable first and second flux. For example, the first flux generator may comprise a conductive path formed as a first coil having a first centre, said conductive path being adapted to guide a first alternating current. Similarly, the second flux generator may comprise a conductive path formed as a second coil having a second centre, said conductive path being adapted to guide a second alternating current.

In order to isolate the conductive paths of the first and second coils and thereby avoid short-circuiting the coils, the conductive paths may be embedded into an isolating material, such as a non-conductive polymer material.

In order to drive the miniature actuator as a loudspeaker the first and second coils may be connected in series so that the same alternating current flows through both coils. In a preferred embodiment, the alternating current in the two series coupled coils flows in opposite directions, with respect to the magnetic bias flux, thereby generating magnetic fluxes with a phase shift of 180°.

The means for generating the permanent magnetic flux through the movable diaphragm may comprise permanent magnets positioned on both sides of the movable diaphragm. More specifically, the generating means may be positioned symmetrically around a centre axis defined by the first and second centres of the coils. In one preferred embodiment, the generating means may be formed as ring magnets forming part of a housing of the miniature actuator. In another embodiment, the permanent magnets may be formed as bar magnets being positioned at or near the centre axis defined by the first and second centres. The permanent magnets can also be fabricated by means of electroplating using materials like Fe, Cr, Co, Ni, Pt, V, Mn, Bi or any combination thereof.

The movable diaphragm may comprise a material for adjusting/tuning the magnetic properties of the movable diaphragm. Suitable candidates adjusting/tuning are Ni, Fe, Co, Cu, Cr, Mo or any combination thereof. The conductive paths of the first and second coils may comprise electroplated Cu, Au or Ag or any combination thereof.

In a second aspect, the present invention relates to a mobile unit comprising a miniature actuator according to the first aspect of the present invention. This mobile unit may be a hearing instrument, a mobile telephone or any other mobile unit.

An aspect of the present invention is the movable diaphragm, said movable diaphragm comprising, in the plane of the diaphragm a substantially stiff centre part, a resilient outer part surrounding the substantially stiff centre part, where in the movable diaphragm shows predetermined magnetic properties, said predetermined magnetic properties varying across the substantially stiff centre part and the resilient outer part so as to avoid saturation effects of the movable diaphragm when the movable diaphragm is positioned in a magnetic flux that varies in the plane of the diaphragm.

The stiff centre part and the resilient outer part may be constituted within the same movable diaphragm. Such integrated movable diaphragm may be fabricated using MST.

The magnetic properties of the movable diaphragm may vary in accordance to a varying thickness of the diaphragm. Alternatively, the magnetic properties of the movable diaphragm may vary in accordance with the properties of an added material. The added material may be selected from the group consisting of Ni, Fe, Co, Cu, Cr, Mo or any combination thereof.

The movable diaphragm may further comprise a plurality of canals adapted to guide air from the centre part of the movable diaphragm to the outer part of the movable diaphragm so as to avoid squeeze film damping effects.

BRIEF DESCRIPTION OF THE DRAWINGS

The present invention will now be explained in further detailed with reference to the accompanying figures, where.

DETAILED DESCRIPTION OF THE INVENTION

Figure 1:
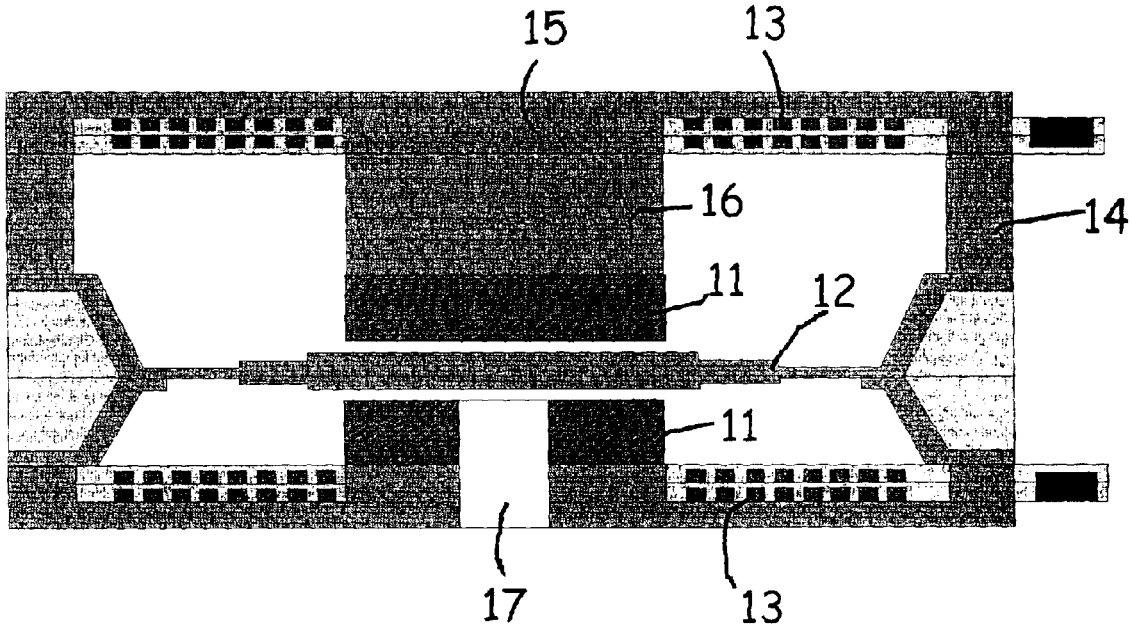
FIG. 1 shows a preferred embodiment of the actuator according to the present invention: two canals 10, two permanent magnets 11, membrane 12, planar coils 13, spacer-chip 14, soft magnetic substrate 15, soft magnetic core 16, and sound outlet opening 17.
Figure 2:
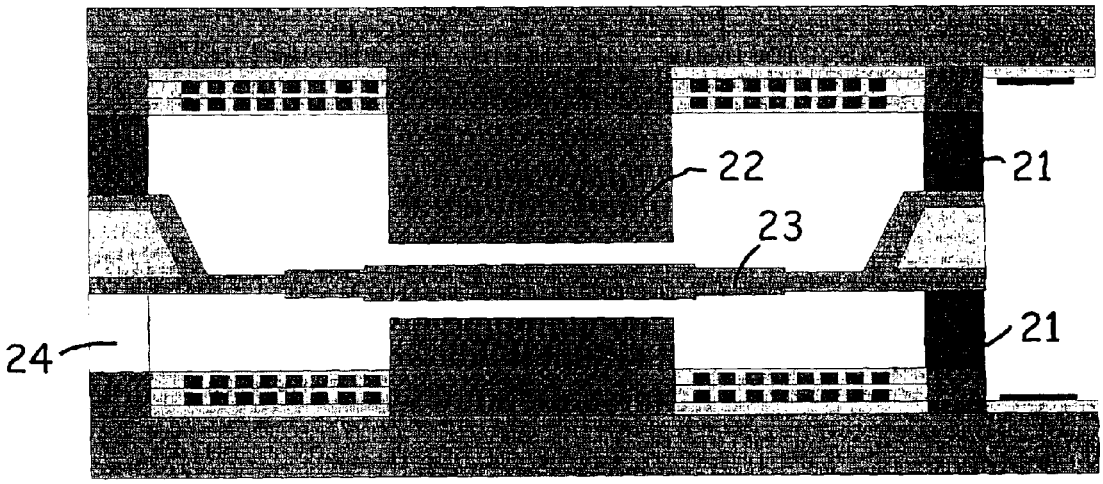
FIG. 2 shows two different designs of the spacer-chip: a) space-chip made of hard magnetic material—no permanent magnet in the middle, and b): structured silicon wafer coated with soft magnetic material—permanent magnet in the middle.
Figure 2:
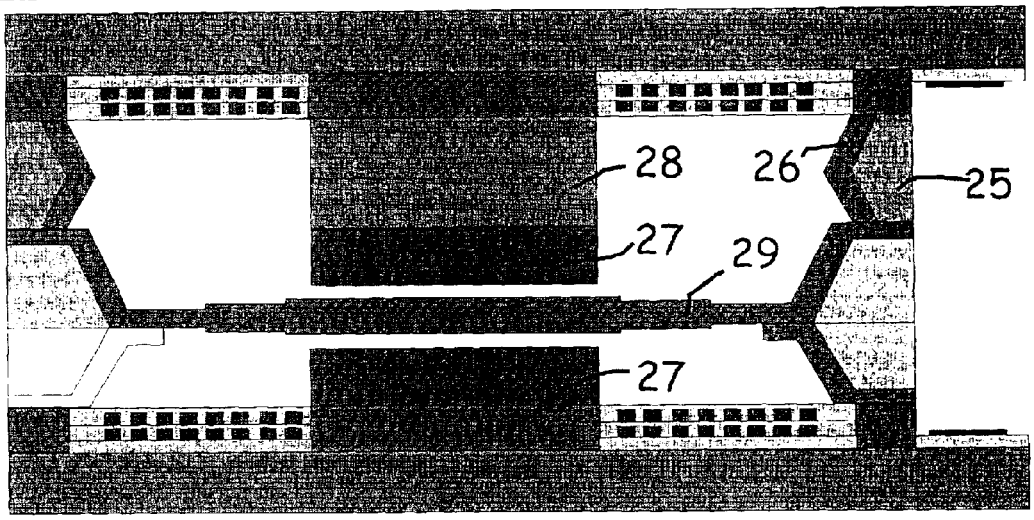
Figure 3:
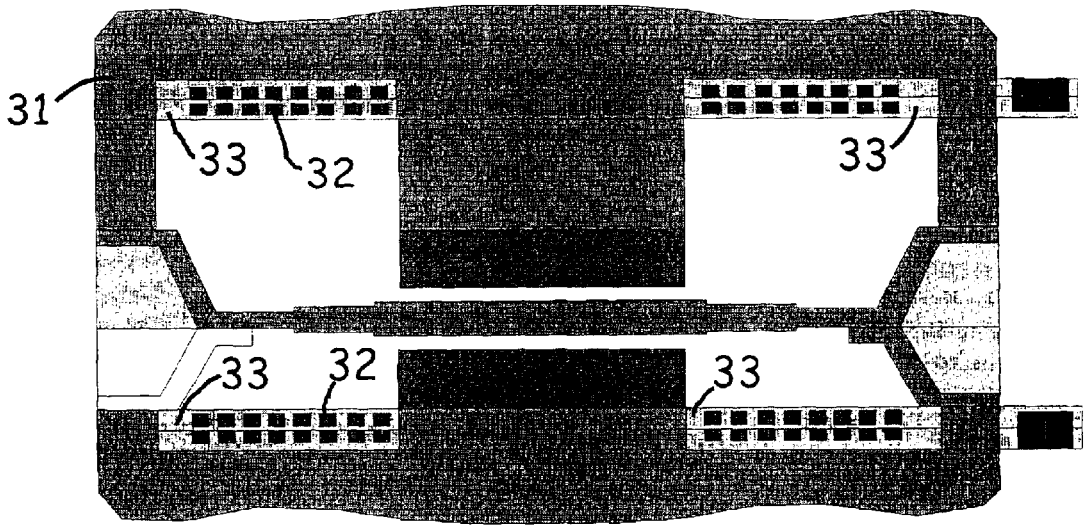
FIG. 3 shows the receiver with two different designs of the flux generators: a) coils 33 and the electroplated flux guiding core material are fabricated on top of a silicon wafer 31, which is removed afterwards, and (b) coils 36 are fabricated directly on a soft magnetic substrate 35; only the outer ring material 39 and the centre core material 38 has to be electroplated in a final step.
Figure 3:
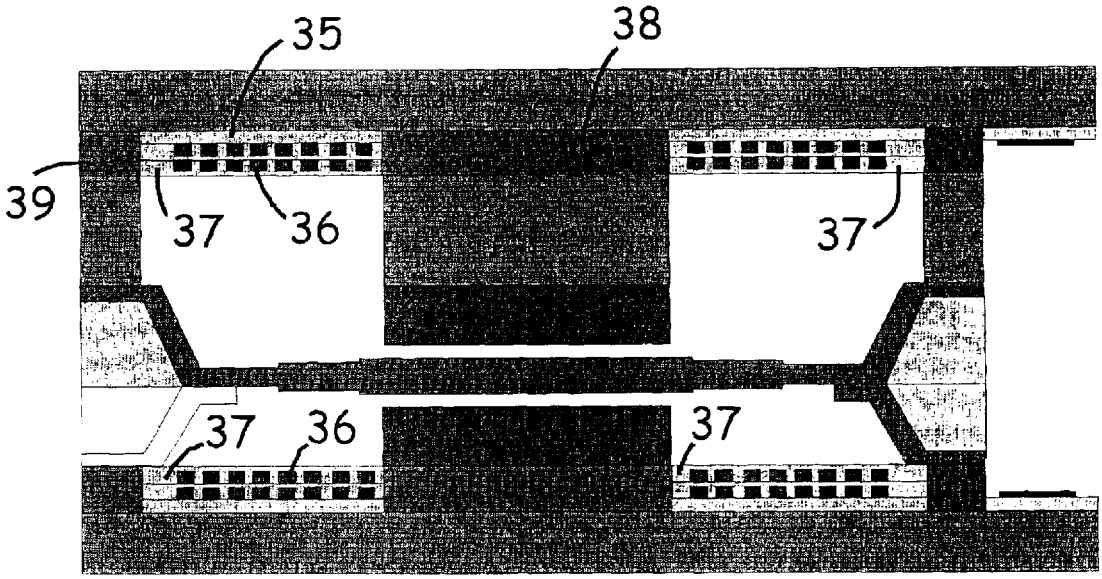

The present invention relates to an actuator operating according to the change in reluctance principle in a balanced configuration—a preferred embodiment is shown in FIG. 1—alternative embodiments are shown in FIGS. 2 and 3. This actuator - here operating as a loudspeaker—consists of two canals 10, two planar coils 13, two permanent magnets 11, a membrane 12 and a spacer chip 14 providing the necessary back chamber volume. The permanent magnets 11 have their magnetisation in the same direction producing a magnetic bias flux across the lower and upper air gap thought the core 16 and the substrate 15 and back through the side walls to the opposite side. The planar coils 13 are driven so that the produced magnetic fluxes are in opposite directions leading to a decreasing flux across one air gap and an increasing flux across the other.

The permanent magnets 11 can either be made of bulk material or by electroless—or electrochemical deposited (plated) material like Fe, Cr, Co, Ni, Pt, V, Mn, Bi or any combination of these materials. The advantage of plating the permanent magnets is related to the opportunity to further decrease the dimensions of the permanent magnets leading to a larger design flexibility, which could contribute to further optimisation of the circuit.

In FIG. 1 the outer ring. i.e. the spacer chip 14 is a rectangular, O-shaped, soft magnetic metal ring. The permanent magnets 11 are positioned in the centre of the planar coils 13, lengthened by the soft magnetic material stamps 16.

A sound outlet opening 17 is preferably positioning in the centre of the lower permanent magnet—thus, the sound outlet opening is positioned on the surface of the actuator. The performance of the magnetic circuit is not worsened by the sound inlet opening magnet, since the centre of the magnet is guiding almost no magnetic flux.

In FIGS. 1–3 the cross-section of the membrane 2 changes with radius due to a higher magnetic flux density in the middle of the membrane than at the rim. Small cananls 10 in the centre of the membrane lead the air from the centre of the membrane to the rim of the membrane thereby minimising squeeze film damping effects in the air gaps between the membrane and the permanent magnets.

In FIG. 2*a* the outer ring 21 forms a permanent magnet. A soft magnetic stamp 22 lengthens the core of the flux generator and defines the gap to membrane 23. A sound outlet opening 24 is located on the vertical side of the actuator. The sound outlet opening shown in FIG. 2*a* is opened during separation of the actuators of a wafer stack, which is done by dicing. However, during the dicing process, cooling water, containing particles of the diced material, could get into the front-chamber, which could lead to the destruction of the actuator. Anyhow, this design is suitable for single-chip-mounting, where the different parts of the loudspeaker are separated and cleaned before mounting.

In FIG. 2*b* the outer ring 25 consists of a silicon wafer, which is etched from both sides and where a layer of soft magnetic material 26 is electroplated on. The magnets 27 are positioned in the centre of the coil, lengthened by a soft magnetic material stamp 28, which defines the air gap to membrane 29.

FIG. 3*a* shows an actuator where the flux generator and the electroplated flux guiding core material are fabricated on top of a silicon wafer 31. The silicon wafer is removed afterwards. Coils 32 are formed by several layers of electroplated copper windings. A polymer 33 electrically insulates the different layers from each other. The mould for electroplating the soft magnetic core material is formed either by photolithography after deposition of the different polymer layers or by means of dry- or wet etching after depositing and curing of the last layer of the multilayer planar coil. In both cases the soft magnetic core material is deposited on the entire coil area providing the magnetic shortcut between the centre and the outer edge of the coil. The substrate is finally removed leaving behind the coils with the core.

In the configuration shown in FIG. 3*b*, the flux generator is fabricated on a soft magnetic substrate 35. Such soft magnetic substrate may be a FeSi-based substrate or any other kind of soft magnetic material. Also here coils 36 are formed by several layers of electroplated copper windings. The different layers are electrically insulated from each other by polymer 37. After producing coils 36 the polymer is structured and used as a mould for the deposition of the core 38.

The force acting on the membrane results from the difference of the magnetic fluxes across the two air gaps on both sides of the membrane and can be calculated by $$F_{mag} = \frac{1\Phi_2^2 - \Phi_1^2}{2\mu_0 \cdot A} \quad [1]$$

where $\Phi_1$ and $\Phi_2$ are the magnetic fluxes across air gap 1 and 2, respectively, $\mu_0$ is the permeability of air and A is the cross-sectional area of the air gap. As seen $F_{mag}$ is equal to zero for equal fluxes—i.e. for $\Phi_1$ equal to $\Phi_2$.

If the membrane deviates from this balanced position due to shock or inaccurate positioning, the fluxes change and the force acting on the membrane increases. The membrane needs a certain stiffness in order to avoid a collapse. Nevertheless, the stiffness of the membrane can be adjusted in a way so that most of the counter force produced during the deflection of the membrane is compensated by the magnetic force produced by the permanent magnets. The additional force generated by the coils is constant for a constant coil current $I_{Coil}$ independent on the position of the membrane for small deflections.

Figure 4:
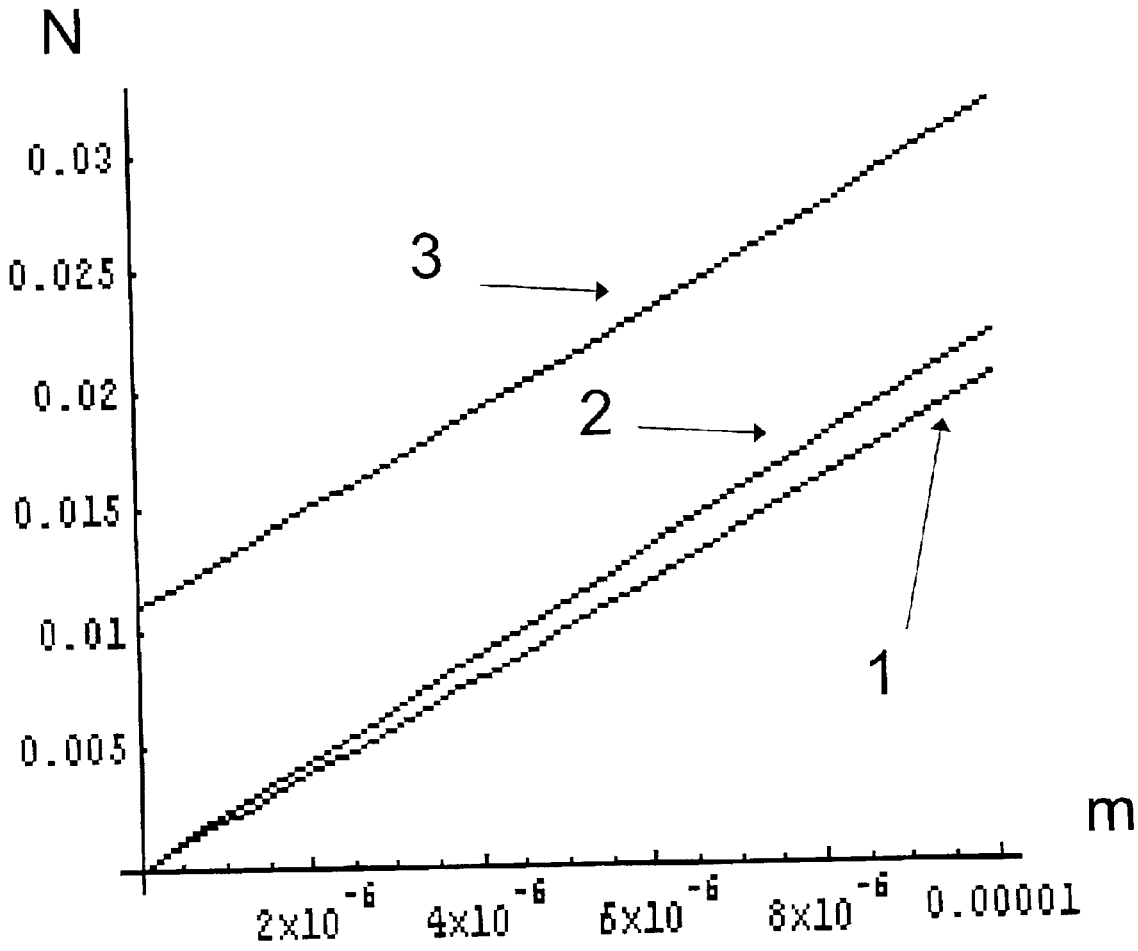
FIG. 4 shows the change of the magnetic force as a function of deflection: Force due to magnetic bias flux 1, restoring (here positive) force of membrane 2 and force "off-set" due to an applied current 3.

Thus, a stiff membrane with high resonance-frequencies can be used without loosing mechanical energy in form of stress during deflection. Typical resonance frequencies are above 10 kHz. An advantage of the present invention is that almost the entire magnetic force offset produced by the coils can be converted into pressure in the back chamber by movements of the membrane. This is seen from FIG. 4.

Due to the high symmetry, there is only little magnetic flux passing the membrane for $I_{Coil}$=0. When a current is applied, only the differential flux passes through the membrane. Thus, it is an advantage of the present invention that the membrane of the actuator can be designed with a much lower cross sectional area than e.g. the core, without reaching saturation.

For the design shown in FIG. 2(120 windings per coil, $H_c$=160 kA/m, permanent magnet height $h_{mag}$=250 μm, outer dimensions of the loudspeaker 4.9×4.9×2 $mm^3$) finite element simulations using ANSYS predict forces up to $F_{mag}$=10 mN for a dc current of about $I_{coil}$=10 mA.

The first step in fabricating the actuator according to the present invention is to produce a flux generator in form of a multi-layer planar coil. The main task in designing the coils is to maximise the number of windings, to minimise the ohmic resistance and to maximise the area of the core to avoid saturation due to the high magnetic flux provided by the permanent magnets. A thick-photoresist process has been developed in order to produce the first layer of the planar coils consisting of copper windings up to a height of 25 μm.

TABLE 1

Design parameters of the produced coils

| Type | 25/18 | 35/20 | 35/25 | 35/30 |
|---|---|---|---|---|
| Pitch [μm] | 25 | 35 | 35 | 35 |
| Line width [μm] | 18 | 20 | 25 | 30 |
| Outer side length [μm] | | 4250 | | |
| Windings n | 60 | 43 | 43 | 43 |

Figure 5:
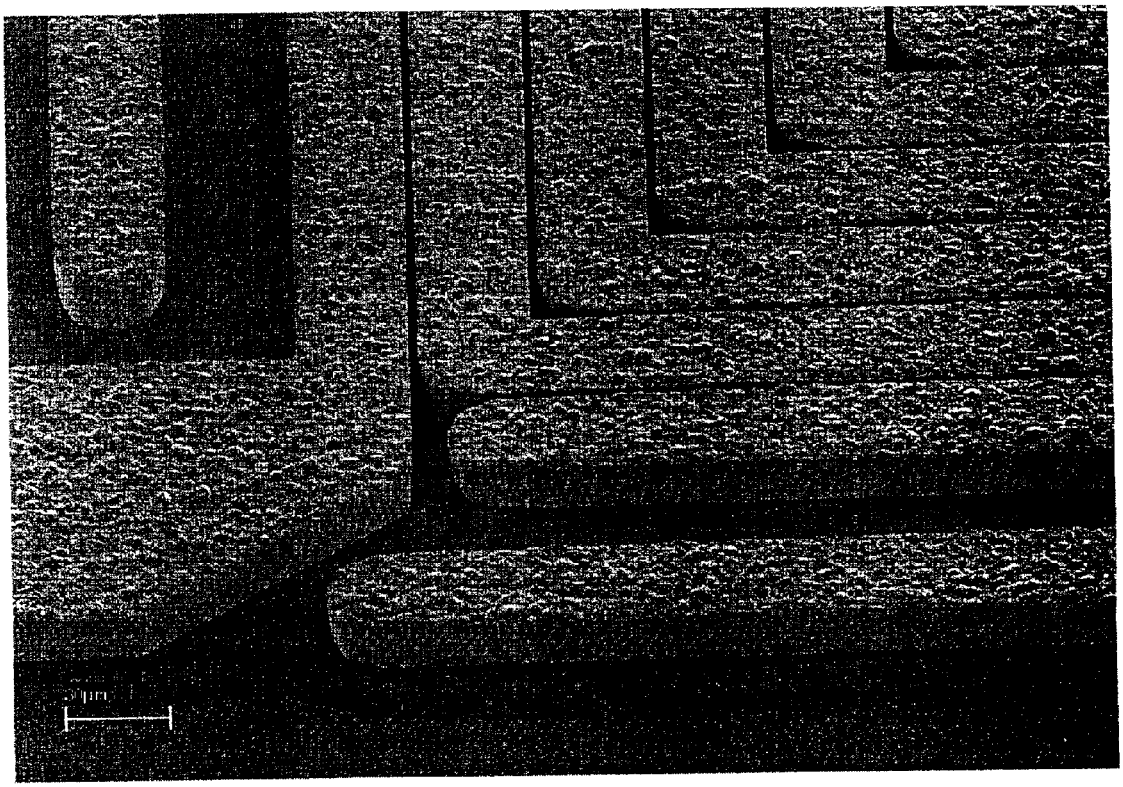
FIG. 5 shows a first layer of planar coil of type 35/30.

FIG. 5 shows a close up of a 20 μm high coil of the type 35/30, the structure has a minimum line width of 31.2 μm leaving a gap of 3.8 μm between the windings. The windings are made of electroplated copper deposited in an AZ4562 mould. Since this resist can be used in very acid environments, an industrial copper bath (pH=0), which runs at room temperature, can be used. Thereby, thermal stress in the structures can be avoided. After the deposition the resist is removed and the seed-layer between the windings is etched.

The following coil parameters are of interest: Inductance L, ohmic resistance R, parasitic capacitance C and resonance frequency $f_0$. The fabricated coils were characterised using a Gain/Phase analyser and a four point probe station.

TABLE 2

Calculated parameters for a planar coil of the type 35/20

| Type 35/20 | R[Ω] | L[μH] | C[pF] | $f_0$[MHz] |
|---|---|---|---|---|
| calculated | 20.9 | 5.62 | 230 | 4.42 |
| measured | 19.85 | 5.3 | 98 | 6.98 |
| | 19.48 | 4.26 | 74.29 | 8.94 |
| | 22.56 | 5.16 | 102.5 | 6.92 |

The Gain/Phase analyser provides a feature for calculating the characteristic parameters of the measured coil using an appropriate equivalent circuit consisting of an inductance and an ohmic resistance in series and a parallel capacitor. Three coils of the type 35/20 were measured and the results are listed together with the calculated ones in Table 2. The results fit very well to the calculations, except for the values of the capacitance. The discrepancy results probably from the model that is used to approximate the circuit, but could also be caused by a depletion layer in the semiconductor substrate underneath the coils.

The membrane is fabricated by electroplating of soft magnetic material in one or several steps. Thereby the thickness of the membrane can be locally increased leading to locally stiffer parts. At the same time these areas of higher thickness lead to a lower magnetic flux density thereby avoiding saturation in the material, which otherwise leads to less output force. Furthermore, a non-uniform topography of the membrane—e.g., canals 10—guides the air in the gap between the permanent magnets and the membrane in order to minimise the squeeze film damping.

The change in thickness is produced e.g. by electroplating of a first soft magnetic layer of a certain thickness on a plane or already structured surface, followed by deposition of a sacrificial layer that can be structured (lithography, wet etch, dry etch, physical, chemical, etc) resulting in a mould for the following process steps. Afterwards a second layer of soft magnetic material is deposited into the mould by electroplating and the sacrificial mould material is removed resulting in a membrane with a cross sectional area changing as a function of the radius. These steps can be repeated to produce even more advanced designs.

The area of the piston like moving part of the membrane has to be maximised, but the compliance of the suspension has to be adjusted to a certain value. This value is depending on the gap-size, the strength of the magnets and the magnetic material properties of the utilized materials, or in short, depending on the change in magnetic flux with increasing deflection of the membrane, when no current is applied to the coils. The stiffening of the centre part can be achieved by adding material (see above) in form of a stiffening frame, thereby keeping the mass of the membrane low and the resonance frequency high.

Squeeze film damping occurs in small gaps. Here, the influence of friction becomes important resulting in losses, lower output, noise etc. Producing small canals 10 in the membrane surface in the area where squeeze film damping occurs can minimise this effect. The canals 10 have to be able to guide air from the centre of the membrane to the outside. In the centre of the membrane, where the magnetic flux is almost zero, the membrane can be thinner whereby the air gap is increased and squeeze film damping effects are reduced.

The magnetic flux density is inversely proportional to the cross sectional area. The highest flux density in the membrane appears in the area of the outer corners of the magnet and decreases with increasing and decreasing radius (the lowest flux density is in the centre of the membrane). In order to minimise the mass of the membrane it is necessary to adapt the cross sectional area of the membrane to the flux density resulting in thicker parts in the area of high flux density and thinner parts in the centre and at the outer radius of the membrane. This can be achieved by applying the steps described above.

What is claimed is:

1. A miniature actuator comprising a first flux generator for generating a controllable first magnetic flux, a second flux generator for generating a controllable second magnetic flux, a movable diaphragm for producing an acoustic output, and means for generating a permanent magnetic flux, wherein the movable diaphragm is positioned between the first and second flux generator, the movable diaphragm having a magnetic material which forms part of a magnetic flux path of the actuator and thereby being movable in response to the generated first and second magnetic fluxes.

2. A miniature actuator according to claim 1, wherein the first flux generator comprises a conductive path formed as a first coil having a first centre, said conductive path being adapted to guide a first alternating current.

3. A miniature actuator according to claim 2, wherein the second flux generator comprises a conductive path formed as a second coil having a second centre, said conductive path being adapted to guide a second alternating current.

4. A miniature actuator according to claim 3, wherein the first and second coils are embedded into a polymer material.

5. A miniature actuator according to claim 3, wherein the first and second coils are connected in series or in parallel producing a magnetic flux, in opposite direction.

6. A miniature actuator according to claim 3, wherein the means for generating the permanent magnetic flux through the movable diaphragm comprises permanent magnets positioned on both sides of the movable diaphragm.

7. A miniature actuator according to claim 6, wherein the permanent magnets are formed as ring magnets, said ring magnets forming part of a housing of the actuator.

8. A miniature actuator according to claim 6, wherein the permanent magnets are formed as bar magnets, said bar magnets being positioned at the centre axis defined by the first and second centres.

9. A miniature actuator according to claim 6, wherein the permanent magnets comprise electroless- or electrochemical deposited material selected from the group consisting of Fe, Cr, Co Ni, Pt, V, Mn, Bi of any combination thereof.

10. A miniature actuator according to claim 6, wherein an opening, so as to form a sound outlet, is comprised in either of the permanent magnets positioned of both sides of the movable diaphragm.

11. A miniature actuator according to claim 10, wherein the sound inlet opening has a substantially circular shape, and is positioned symmetrically around the centre axis defined by the first and second centres.

12. A miniature actuator according to claim 3, wherein the means for generating the permanent magnetic flux through the movable diaphragm is positioned symmetrically around a centre axis defined by the first and second centres.

13. A miniature actuator according to claim 6, wherein in the conductive paths of the first and second coils comprise electroplated Cu, Au of Ag of any combination.

14. A miniature actuator according to claim 1, wherein the movable diaphragm comprises a material for adjusting the magnetic properties of the movable diaphragm, said material being selected from the group consisting of Ni, Fe, Co Cu, Cr, Mo or any combination thereof.

15. A mobile unit comprising a miniature actuator according to claim 1.

16. A mobile unit according to claim 15, wherein the mobile unit is a hearing instrument.

17. A mobile unit according to claim 15, wherein the mobile unit is a mobile of cellular phone.

18. A miniature actuator according to claim 1, wherein the movable diaphragm comprises, in a plane of the diaphragm, a substantially stiff centre part, a resilient outer part surrounding the substantially stiff centre part, wherein the movable diaphragm shows predetermined magnetic properties, said predetermined magnetic properties varying across the substantially stiff centre part and the resilient outer part so as to avoid saturation effects of the movable diaphragm when the movable diaphragm is positioned in a magnetic flux that varies in the plane of the diaphragm.

19. A miniature actuator according to claim 18, wherein the magnetic properties of the movable diaphragm varies according to a varying thickness of the diaphragm.

20. A miniature actuator according to claim 18, wherein the magnetic properties of the movable diaphragm varies according an added material, wherein the added material is selected from the group consisting of Ni, Fe, Cu, Cr, Mo or any combination thereof.

21. A miniature actuator according to claim 18, further comprising a plurality of canals adapted to guide air from the centre part of the movable diaphragm to the outer part of the movable diaphragm so as to reduce/minimise squeeze film damping effects.

* * * * *

UNITED STATES PATENT AND TRADEMARK OFFICE

CERTIFICATE OF CORRECTION

PATENT NO. : 7,054,460 B2
APPLICATION NO. : 09/964897
DATED : August 14, 2006
INVENTOR(S) : Pirmin Rombach et al.

It is certified that error appears in the above-identified patent and that said Letters Patent is hereby corrected as shown below:

We have found the following errors in the patent:

Claim 1, Column 7 line 51: “magnetic material” should be replaced by --soft magnetic material--.

Claim 9, Column 8 line 14: “of” should be replaced by --or--.

Claim 10, Column 8 line 17: the second occurance of “of” should be replaced by --on--.

Claim 13, Column 8 line 27: “according to claim 6” should be replaced by --according to claim 3--; Column 8 line 27, remove the term --in--.

Claim 13, Column 8 line 29: “of Ag of any combination” should be replaced by --or Ag or any combination thereof--.

Claim 17, Column 8 line 39: “of cellular” should be replaced by --or cellular--.

Signed and Sealed this

Seventeenth Day of October, 2006

JON W. DUDAS
*Director of the United States Patent and Trademark Office*

UNITED STATES PATENT AND TRADEMARK OFFICE

CERTIFICATE OF CORRECTION

PATENT NO. : 7,054,460 B2
APPLICATION NO. : 09/964897
DATED : May 30, 2006
INVENTOR(S) : Pirmin Rombach et al.

It is certified that error appears in the above-identified patent and that said Letters Patent is hereby corrected as shown below:

We have found the following errors in the patent:

Claim 1, Column 7 line 51: "magnetic material" should be replaced by --soft magnetic material--.

Claim 9, Column 8 line 14: "of" should be replaced by --or--.

Claim 10, Column 8 line 17: the second occurance of "of" should be replaced by --on--.

Claim 13, Column 8 line 27: "according to claim 6" should be replaced by --according to claim 3--; Column 8 line 27, remove the term --in--.

Claim 13, Column 8 line 29: "of Ag of any combination" should be replaced by --or Ag or any combination thereof--.

Claim 17, Column 8 line 39: "of cellular" should be replaced by --or cellular--.

This certificate supersedes Certificate of Correction issued October 17, 2006.

Signed and Sealed this

Twenty-first Day of November, 2006

JON W. DUDAS
*Director of the United States Patent and Trademark Office*